US006079137A

United States Patent [19]

Mitchell

[11] Patent Number: 6,079,137

[45] **Date of Patent: *Jun. 27, 2000**

[54] PROTECTIVE TAG RECEPTACLE

[76] Inventor: Randy Dwayne Mitchell, P.O. Box 748, Bend, Oreg. 97709

[ * ] Notice: This patent is subject to a terminal disclaimer.

[21] Appl. No.: 09/169,089

[22] Filed: Oct. 8, 1998

Related U.S. Application Data

[62] Division of application No. 08/969,096, Nov. 13, 1997, Pat. No. 5,845,424.

[51] Int. Cl.[7] ..... G09F 3/18

[52] U.S. Cl. ..... 40/611.06; 40/661

[58] Field of Search ..... 53/467; 40/634, 40/366, 661, 661.05, 661.06, 661.07, 668, 705, 706, 781, 1.6; 206/0.8, 0.82, 232, 449, 450, 39; 70/456 R, 460; 292/307 A, 307 B; 150/147

[56] References Cited

U.S. PATENT DOCUMENTS

| | | | |
|---|---|---|---|
| 135,155 | 1/1873 | Ranson . | |
| 281,163 | 7/1883 | Thompson . | |
| 311,331 | 1/1885 | LaForge et al. . | |
| 1,061,364 | 5/1913 | Ewing . | |
| 1,066,129 | 7/1913 | Manasse . | |
| 1,846,591 | 2/1932 | Guerin . | |
| 2,176,253 | 10/1939 | Fogarty . | |
| 2,213,075 | 8/1940 | Ross . | |
| 3,111,152 | 11/1963 | Goessling et al. . | |
| 3,141,258 | 7/1964 | Mayer | 43/57.1 |
| 3,982,343 | 9/1976 | Klingler | 40/27.5 |
| 4,015,361 | 4/1977 | O'Reilly et al. | 43/25.2 |
| 4,289,691 | 9/1981 | Manjos et al. | 40/661 |
| 4,452,003 | 6/1984 | Deutsch et al. | 43/25.2 |
| 5,018,291 | 5/1991 | Pasquale et al. | 40/781 X |
| 5,113,602 | 5/1992 | Levine et al. | 40/634 |
| 5,230,172 | 7/1993 | Hsu | 40/661 X |
| 5,452,930 | 9/1995 | Morgan | 292/307 A |
| 5,845,424 | 12/1998 | Mitchell | 40/661.06 |

OTHER PUBLICATIONS

Mary Beth's Beanie World Magazine, "Smart Heart," vol. 1, No. 2, 1997.

*Primary Examiner*—Brian K. Green
*Attorney, Agent, or Firm*—Chernoff, Vilhauer, McClung & Stenzel, LLP

[57] ABSTRACT

A protective repository for a tag having a first portion defining a cavity having an inwardly facing sidewall and a bottom wall and conforming to the shape of the tag. A second portion defines a raised area having an outwardly facing sidewall and a top wall. The outwardly facing sidewall is shaped to fit matingly the inwardly facing sidewall surface so that the top wall is adjacent to the bottom wall thereby retaining the tag.

15 Claims, 2 Drawing Sheets

PROTECTIVE TAG RECEPTACLE

This application is a divisional of Ser. No. 08/969,096, filed Nov. 13, 1997, now U.S. Pat. No. 5,845,424.

BACKGROUND OF THE INVENTION

The present invention is directed to providing a protective repository for a tag and its associated tag string tab and a method for using the same.

The collection of plush dolls has become a major business in which plush dolls can sell for thousands of dollars. Currently, a successful line of plush dolls appealing to collectors is the Beanie Babies™ collection distributed in the United States by Ty Inc. These dolls come with a side-truncated heart shaped tag, announcing the status of the doll as one of the Beanie Babies™ and providing the specific toy name. This tag is retained by a plastic tag string having a tab at a first end, extending through an opening in the tag and through the plush doll and expanding for retention by the doll at a second end.

The condition of the side-truncated heart shaped tag is one of the principal pricing determinants of a plush doll on the retail market. The marring of a tag can, therefore, result in a large monetary loss for the owner of a rare plush doll. Unfortunately, for the plush doll owner who wishes to protect his investment, the options for protecting tags are quite limited. A soft sleeve is available, but does not offer protection against bending. A hard plastic case having two hinged heart shaped sides is available, but suffers from a number of serious shortcomings. First, there is no accommodation for the tab. This means that in putting the tag into the case and closing the case, the doll owner risks the very harm he is trying to avoid: marring the tag, in this case by having it bent and crushed by the tab. Second, there is no structure to guide the user in placing the tag into the case. Hence, the user must be very careful to align the tag into the case before closing the case or risk catching a portion of the tag between the mating rims of the two case halves when the case is closed, thereby damaging the tag. Finally, the case has no latching mechanism, relying on the stiffness of the hinge to keep the case shut after it is closed. This does not provide very reliable protection. In addition, the use of a stiff hinge material tends to result in hinge deterioration and eventual breakage after the case has been opened and closed a few times.

SUMMARY OF THE INVENTION

The present invention is a protective repository for a tag, the device having a first portion including an inwardly facing sidewall surface and a bottom wall that together define a cavity that conforms to the shape of the tag. A second portion defines a raised area having an outwardly facing sidewall surface and a top wall. The outwardly facing sidewall is shaped to fit matingly inside the inwardly facing sidewall so that the top wall is adjacent to the bottom wall.

In a separate aspect of the present invention, a protective repository is provided for a tag having an aperture through which a tag string passes, the tag string having an attached enlargement at a first end to function as a tab for retaining the tag. The repository comprises a cavity defining structure adapted to receive the tag. The structure further includes an indentation defining a subcavity adapted to receive the tab.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
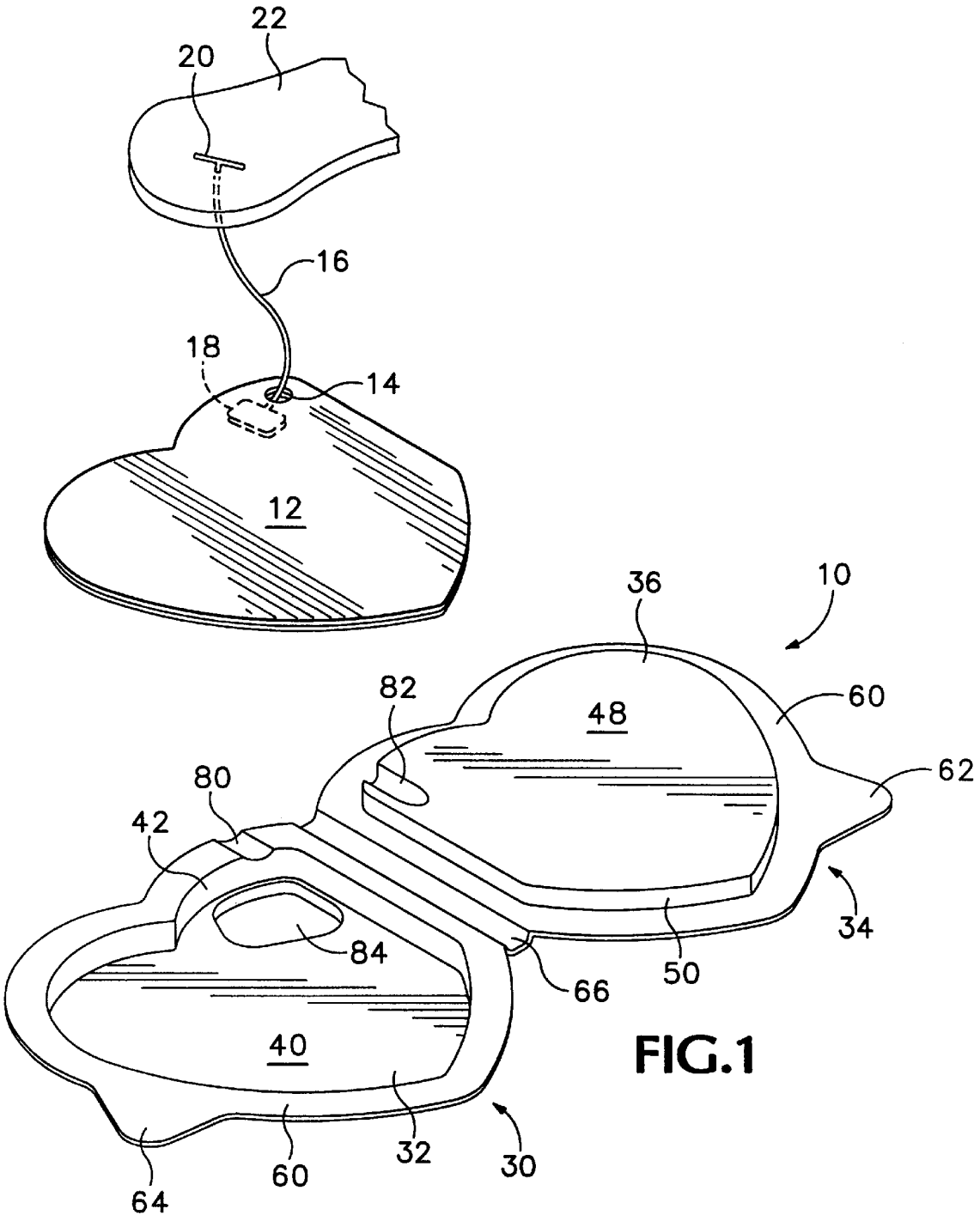
FIG. 1 is an isometric drawing of a protective tag receptacle according to the present invention with a tag positioned for placement into the receptacle.
Figure 2:
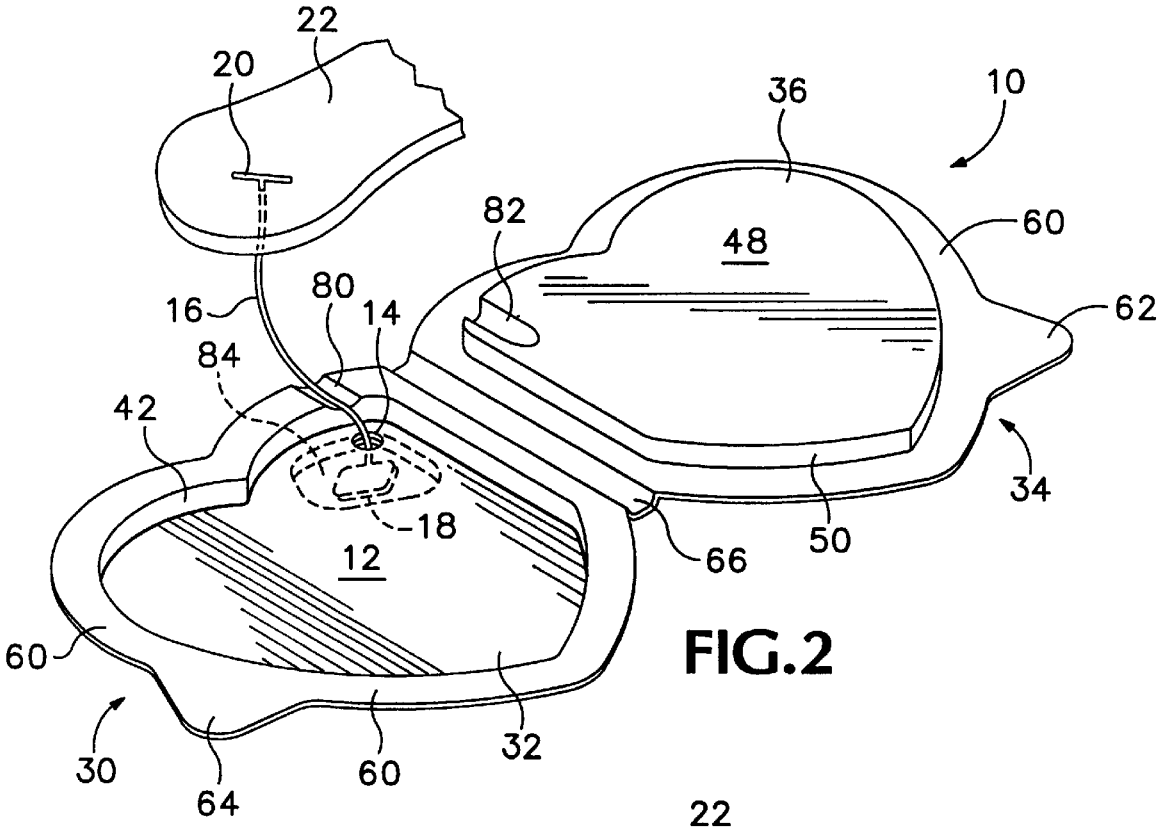
FIG. 2 is an isometric drawing of the protective tag receptacle of FIG. 1 with a tag positioned in the cavity of the receptacle.
Figure 3:
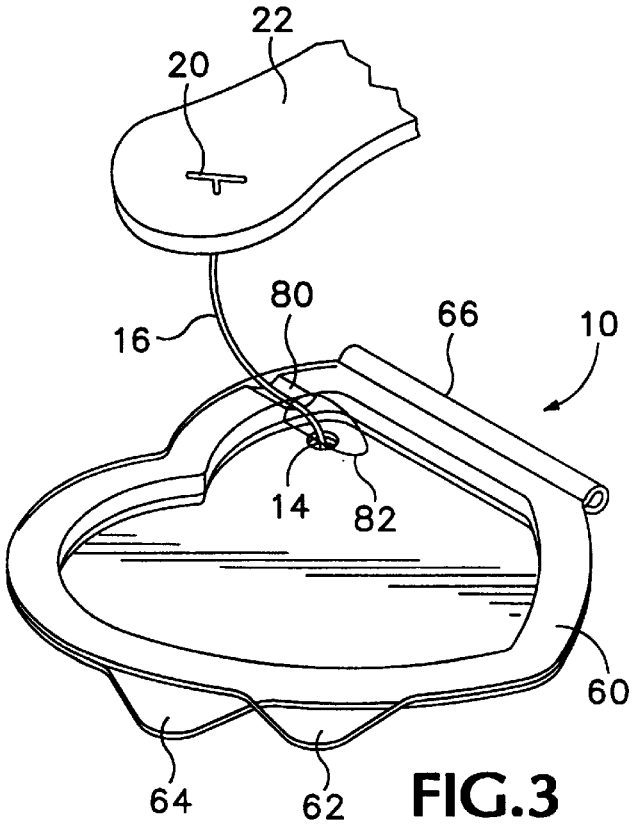
FIG. 3 is an isometric drawing of the protective tag receptacle of FIG. 1 being closed about a tag.

The present invention is embodied, for example, in a protective receptacle 10 for protecting a hang tag such as the tag 12 while the hang tag remains connected to a separate article. Tag 12 defines an aperture 14 through which a tag string 16 passes. The tag string 16 has a tab 18 at a first end for retaining tag 12 on tag string 16. A second tag string end 20 is typically strung through a plush doll toy 22. Receptacle 10 includes a first portion 30, defining a cavity 32 and a second portion 34 defining a raised area 36. Cavity 32 is defined by a bottom wall 40 and an inwardly facing sidewall surface 42. Raised area 36 has a top wall 48 and an outwardly facing side wall surface 50. Cavity 32 conforms to the shape of tag 12 (in this application the word "shape" refers to the two dimensional outline of a flat tag). Surface 50 is shaped to matingly fit within the contours of surface 42.

A rim 60 surrounds both first portion 30 and second portion 34 and widens into opening tabs 62 and 64 to facilitate the manipulation of repository 10. A flexible portion or live hinge 66 permits the second portion 34 to be rotated into mating engagement with portion 30. A pair of channels 80 and 82 cooperatively define a passage for the tag string 16 when portions 30 and 34 are mated together. Finally, an indentation 84 defines a subcavity for receiving tab 18.

To use receptacle 10 a user places tag 12 into cavity 32 so that tab 18 rests in the subcavity defined by indentation 84. Cavity 32 serves as a guide for the correct placement of tag 12. Finally the user rotates portion 34 about hinge 66 and engages portion 34 with portion 30 by fitting surface 50 into mating engagement with surface 42 so that bottom wall 40 is adjacent to top wall 48 and tag 12 is held between bottom wall 40 and top wall 48. The two parts are of closely fitting shape and size, so they are held together by friction sufficiently well to be safe in protecting the tag 12. Because the user has had the benefit of using cavity 32 as a guide, he can be assured that there is no portion of tag 12 positioned outside of cavity 32 where it would likely be damaged by the engagement of second portion 34 with first portion 30.

Receptacle 10 is preferably vacuum formed and die-cut from a sheet of transparent acid-free polymeric material such as polyvinyl chloride.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A method of protecting a side-truncated heart shaped doll tag having an aperture through which a tag string passes, said tag string having a tab attached to a first end thereof for retaining said tag, said method comprising the steps of:

(a) providing a tag repository having an exterior and including:

(i) a first portion defining a side-truncated heart shaped cavity having an inwardly facing sidewall surface and a bottom wall including an indentation defining a subcavity and wherein said inwardly facing sidewall surface has a top and said first portion further includes a first rim extending outwardly from said top of said inwardly facing sidewall surface; and (ii) a second portion defining a raised second rim having an outwardly facing sidewall surface and a top surface, said outwardly facing sidewall surface being shaped to fit matingly inside said inwardly facing sidewall surface so that said top surface is adjacent to said bottom wall and wherein said outwardly facing sidewall surface has a bottom and said second portion further includes a third rim extending outwardly from said bottom of said outwardly facing sidewall surface; and (b) placing said side-truncated heart shaped doll tag into said cavity and said tab into said subcavity; and (c) fitting said raised second rim into said cavity so that said top surface is adjacent to said bottom wall and said tag is retained within said repository and said tag string passes between said first rim and said third rim from said side-truncated heart shaped cavity to said exterior of said repository.

2. The method of claim 1 wherein said first portion and said second portion are connected by a hinge and step (c) is accomplished by rotating said second portion about said hinge.

3. The method of claim 1 wherein said tag repository is a formed sheet of transparent polymeric material.

4. The method of claim 1 wherein said first rim and said third rim both widen outwardly to form offset opening tabs.

5. The method of claim 1 wherein an open channel facing said third rim and connecting said cavity to said repository exterior is formed in said first rim and said tag string passes through said open channel in step (c).

6. The method of claim 1 wherein an open channel facing said first rim and connecting said cavity to said repository exterior is formed in said third rim and said tag string passes through said open channel in step (c).

7. The method of claim 1 wherein said raised second rim substantially surrounds an area and wherein said top surface is substantially coextensive to said area substantially surrounded by said second rim.

8. A method of protecting a doll tag having a shape and also having an aperture through which a tag string passes, said tag string having a tab attached to a first end thereof for retaining said tag, said method comprising the steps of:

(a) providing a tag repository having an exterior and including:

(i) a first portion defining a cavity substantially in said shape of said tag and having an inwardly facing sidewall surface and a bottom wall including an indentation defining a subcavity and wherein said inwardly facing sidewall surface has a top and said first portion further includes a first rim extending outwardly from said top of said inwardly facing sidewall surface; and (ii) a second portion defining a raised second rim having an outwardly facing sidewall surface and a top surface, said outwardly facing sidewall surface being shaped to fit matingly inside said inwardly facing sidewall surface so that said top surface is adjacent to said bottom wall and wherein said outwardly facing sidewall surface has a bottom and said second portion further includes a third rim extending outwardly from said bottom of said outwardly facing sidewall surface; and (b) placing said doll tag into said cavity and fitting said tab into said subcavity; and (c) fitting said raised second rim into said cavity so that said top surface is adjacent to said bottom wall and said tag is retained within said repository and said tag string passes between said first rim and said third rim from said cavity to said exterior of said repository.

9. The method of claim 8 wherein said first portion and said second portion are connected by a hinge and step (c) is accomplished by rotating said second portion about said hinge.

10. The method of claim 8 wherein said tag repository is a formed sheet of transparent polymeric material.

11. The method of claim 8 wherein said first rim and said third rim both widen outwardly to form offset opening tabs.

12. The method of claim 8 wherein an open channel facing said third rim and connecting said cavity to said repository exterior is formed in said first rim and said tag string passes through said open channel in step (c).

13. The method of claim 8 wherein an open channel facing said first rim and connecting said cavity to said repository exterior is formed in said third rim and said tag string passes through said open channel in step (c).

14. The method of claim 8 wherein said raised second rim substantially surrounds an area and wherein said top surface is substantially coextensive to said area substantially surrounded by said second rim.

15. A method of protecting a doll tag having a shape and also having an aperture through which a tag string passes, said tag string having a tab attached to a first end thereof for retaining said tag, said method comprising the steps of:

(a) providing a tag repository having an exterior and including:

(i) a first portion defining a cavity substantially in said shape of said tag and having a first sidewall surface and a bottom wall including an indentation defining a subcavity and wherein said first portion further includes a first rim extending outwardly from said first sidewall surface; and (ii) a second portion having a second sidewall surface being shaped to fit matingly with said first sidewall surface and wherein said second portion further includes a second rim extending outwardly from said second sidewall surface; and (b) placing said doll tag into said cavity and fitting said tab into said subcavity; and (c) fitting said second sidewall surface together with said first sidewall surface so that said tag is retained within said repository and said tag string passes from within said closed repository to said exterior of said repository.

* * * * *